US007721477B2

(12) United States Patent
Loguercio

(10) Patent No.: US 7,721,477 B2
(45) Date of Patent: May 25, 2010

(54) PIG BOARD

(76) Inventor: Susan Ann Loguercio, 247 Irish Way, Pismo Beach, CA (US) 93449

( * ) Notice: Subject to any disclaimer, the term of this patent is extended or adjusted under 35 U.S.C. 154(b) by 16 days.

(21) Appl. No.: 12/074,806

(22) Filed: Mar. 4, 2008

(65) Prior Publication Data

US 2009/0223098 A1 Sep. 10, 2009

(51) Int. Cl.
*G09F 3/20* (2006.01)

(52) U.S. Cl. ..... 40/658; 434/408; 40/600

(58) Field of Classification Search ..... 40/657
See application file for complete search history.

(56) References Cited

U.S. PATENT DOCUMENTS

D107,246 S * 11/1937 Luteran et al. ..... D7/699
3,463,309 A * 8/1969 Szostek ..... 206/470
5,755,337 A * 5/1998 Linn ..... 211/13.1
5,829,073 A * 11/1998 Lee ..... 4/661
6,736,644 B1 * 5/2004 Vaughn ..... 434/408

OTHER PUBLICATIONS

Pig!. flickr. http://www.flickr.com/photos/abbylee123/530972367/. uploaded Jun. 4, 2007.*
Double Pig Pin/Tack. Iten # JW045. Pigs4Ever.com http://web.archive.org/web/20070312163316/www.pigs4ever.com/PotBelliedPigProducts/pig_jewelry2.htm Mar. 12, 2007.*
Pig message board. http://web.archive.org/web/20070629063543/www.ginkofolkart.com/dry_erase_boards.htm Jun. 29, 2007.*
Bella Pig Magnetic Board. http://www.conranshop.co.uk/productlist.aspx?cid=GiftsForChildren&language=en-GB Mar. 29, 2009.*

* cited by examiner

*Primary Examiner*—Cassandra Davis
(74) *Attorney, Agent, or Firm*—Andrew Schroeder; Law Office of Andrew Schroeder

(57) ABSTRACT

A pig board for the purpose of displaying various images includes a planar member shaped substantially to the profile of a pig. The planar member includes a first side, a second side, an anterior end and a posterior end.

1 Claim, 12 Drawing Sheets

950

PIG BOARD

FIELD OF THE INVENTION

The present invention relates with an apparatus for the purpose of displaying various images or photos.

BACKGROUND OF THE INVENTION

For various reasons, people may like to display their frustrations upon various walls or surfaces. These frustrations may be embodied in various photos or images which resemble the people with which their frustrations originate. For some, these people may be called "pigs".

What is needed in the marketplace is an apparatus for the purpose of displaying images of people with which people have frustration. Such an apparatus should be a fun means of displaying and sublimating their frustrations in a clean and fun way.

BRIEF DESCRIPTION OF THE DRAWING FIGURES

FIG. 9*a* is a plan view of a preferred embodiment of the present invention.

FIG. 9*b* is a plan view of a preferred embodiment of the present invention.

FIG. 9*c* is a plan view of a preferred embodiment of the present invention.

FIG. 9*d* is a plan view of a preferred embodiment of the present invention.

Figure 10:
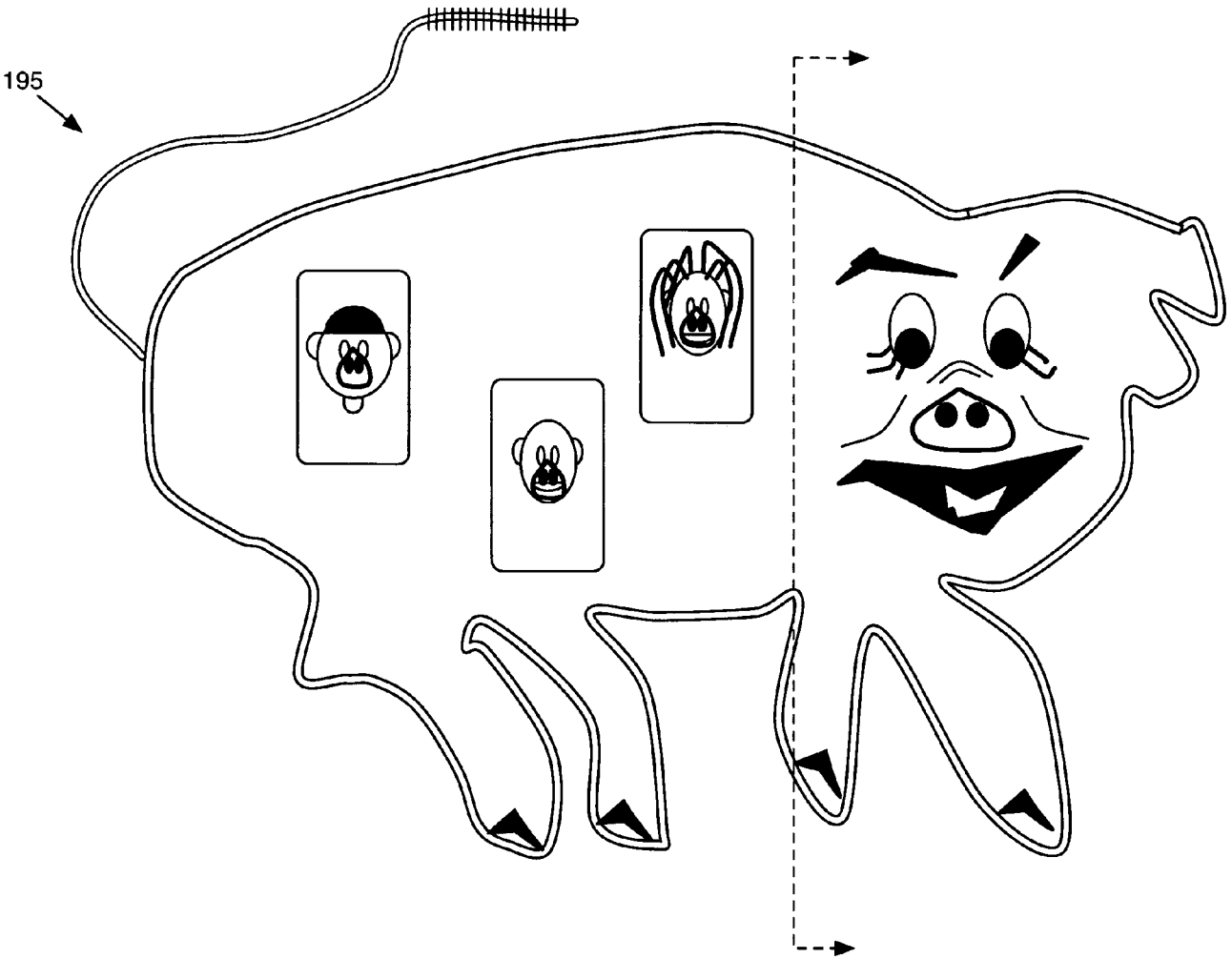

FIG. 10 is a plan view of a preferred embodiment of the present invention.

Figure 11:
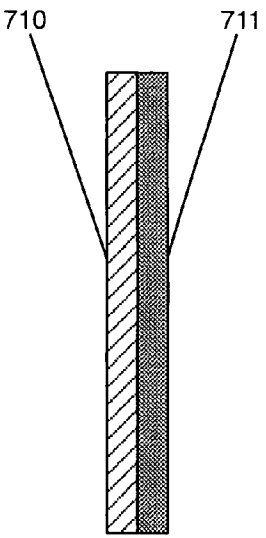

FIG. 11 is a plan view of a preferred embodiment of the present invention.

Figure 12:
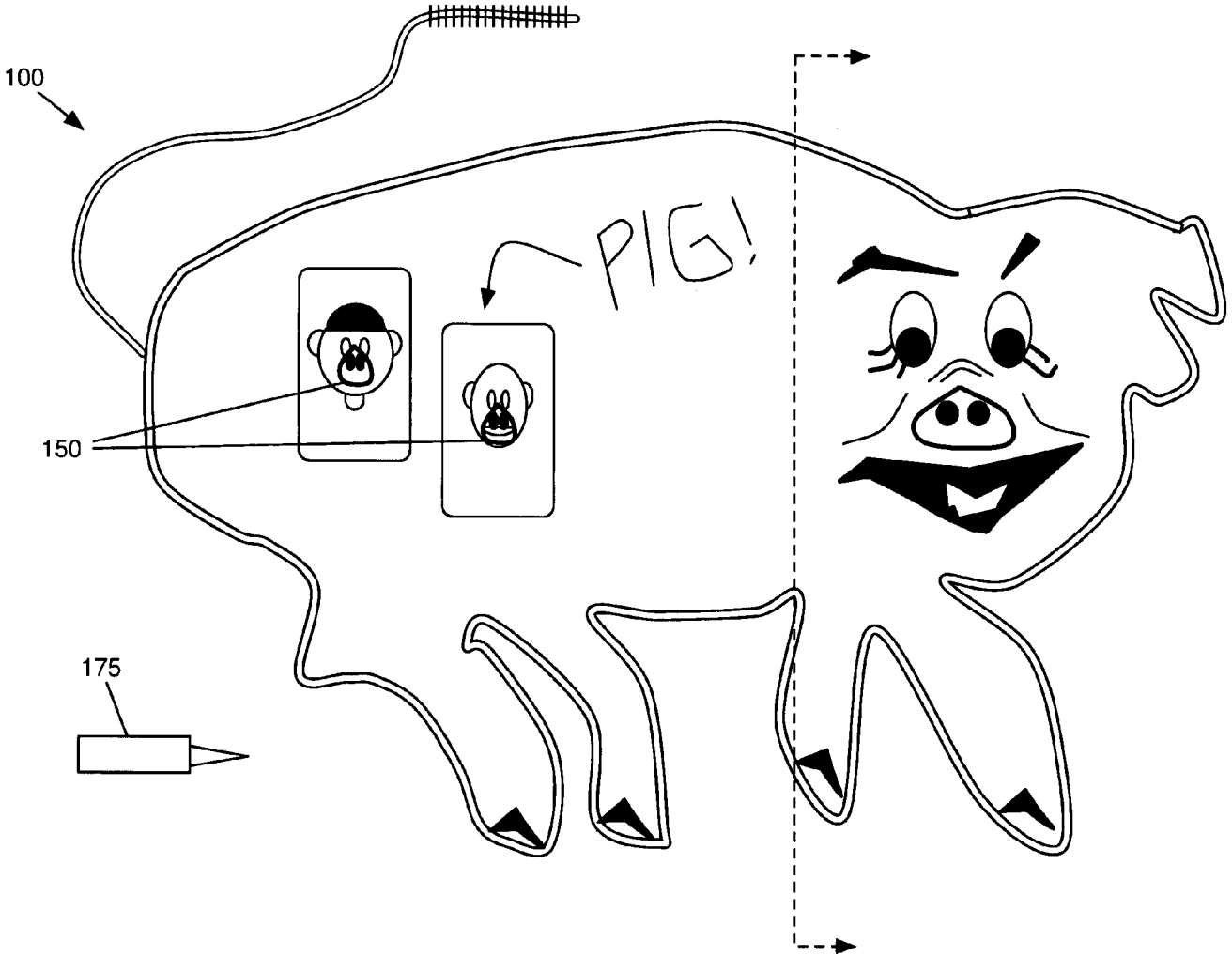

FIG. 12 is a plan view of a preferred embodiment of the present invention.

Figure 13:
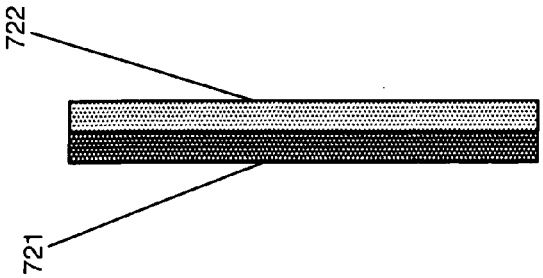

FIG. 13 is a plan view of a preferred embodiment of the present invention.

Figure 14:
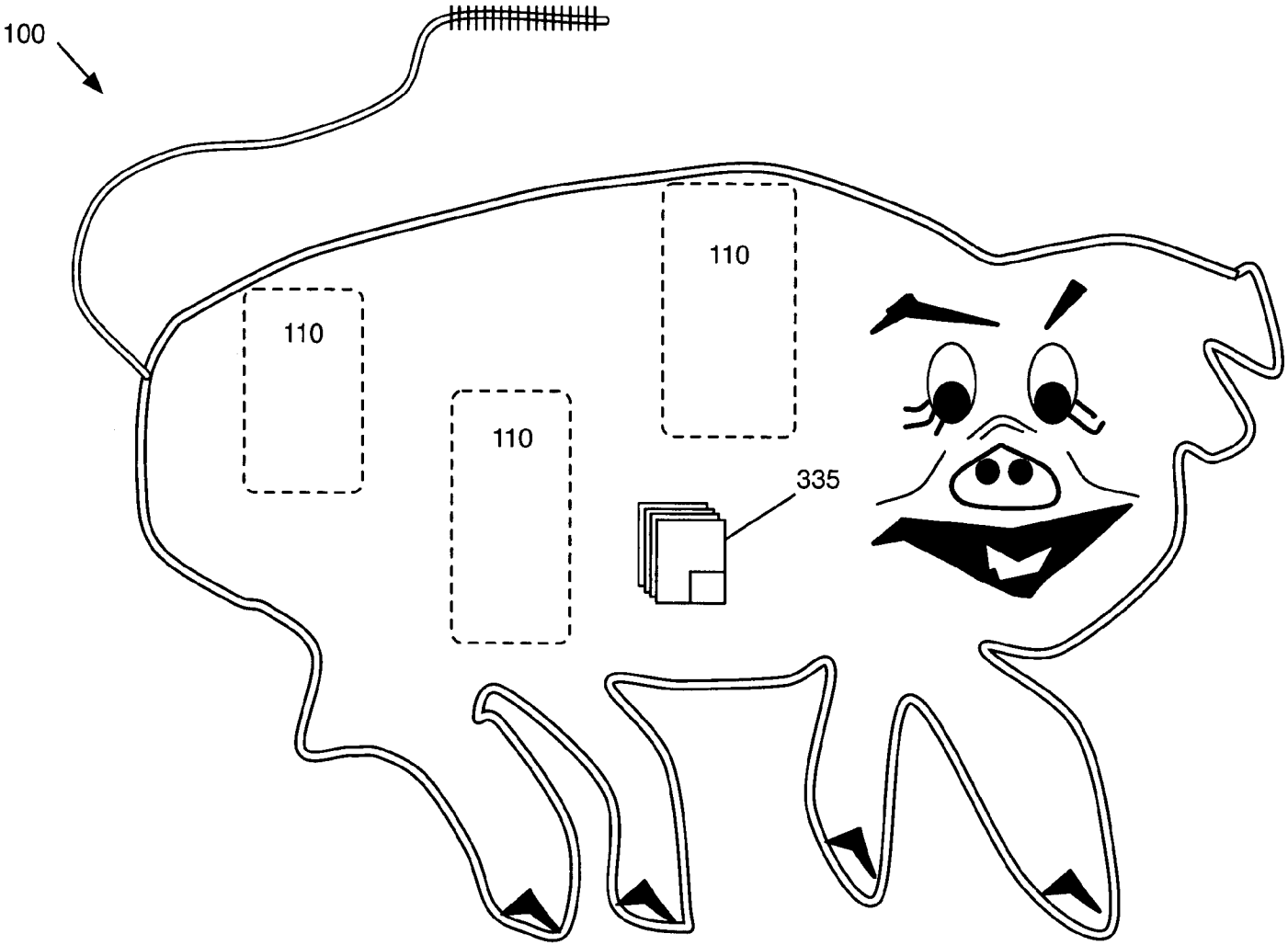

FIG. 14 is a plan view of a preferred embodiment of the present invention.

Figure 15:
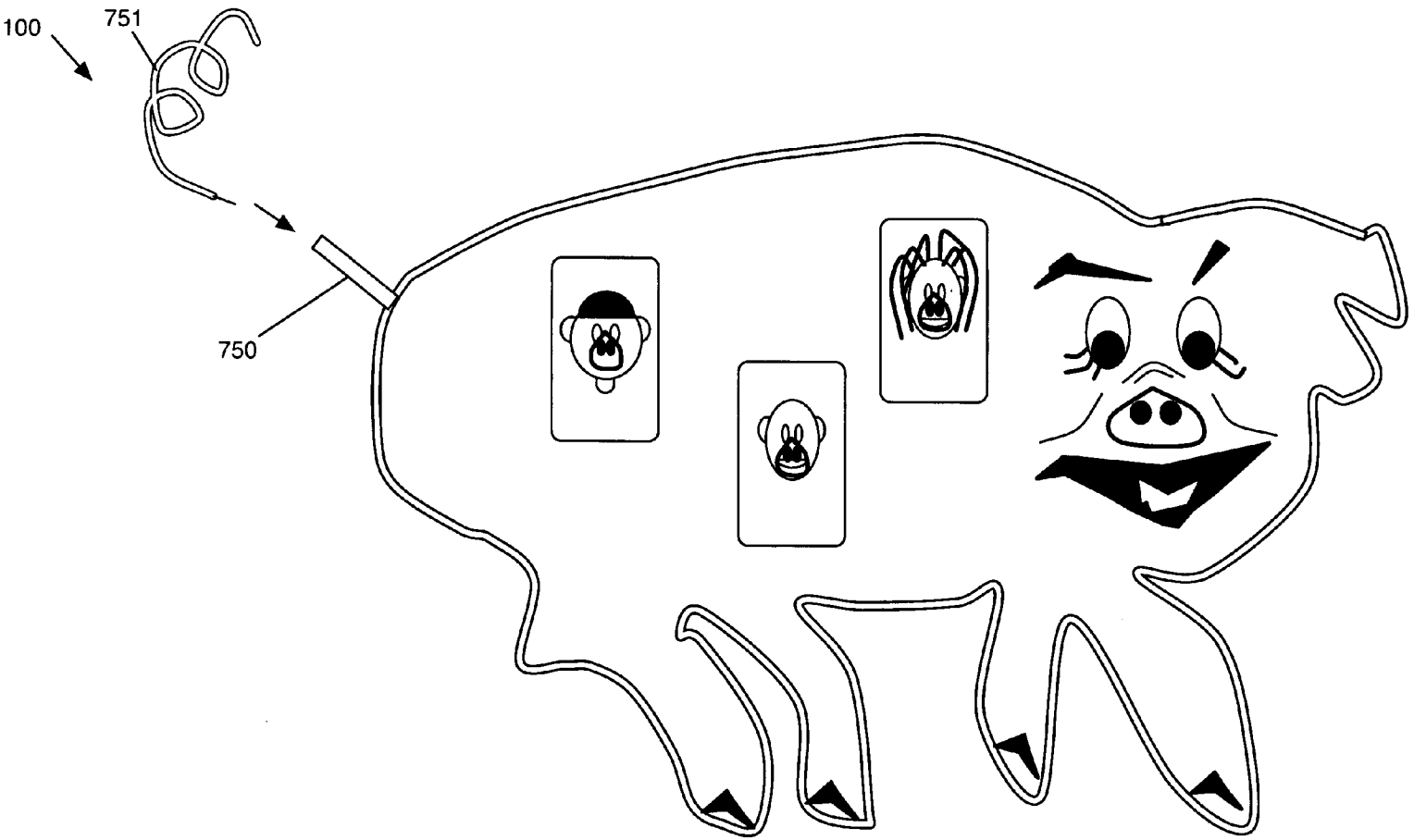

FIG. 15 is a plan view of a preferred embodiment of the present invention.

Figure 16:
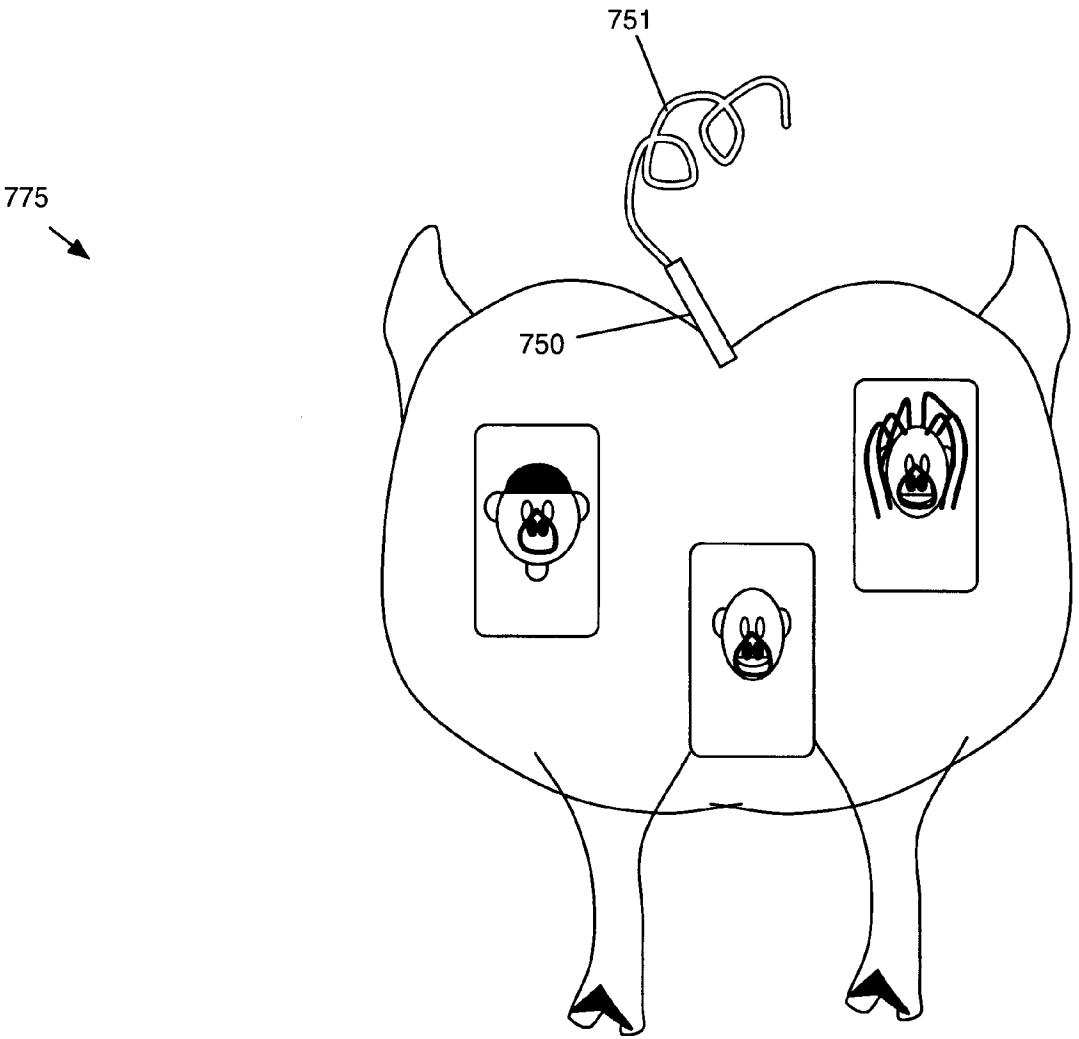

FIG. 16 is a plan view of a preferred embodiment of the present invention.

Figure 17:
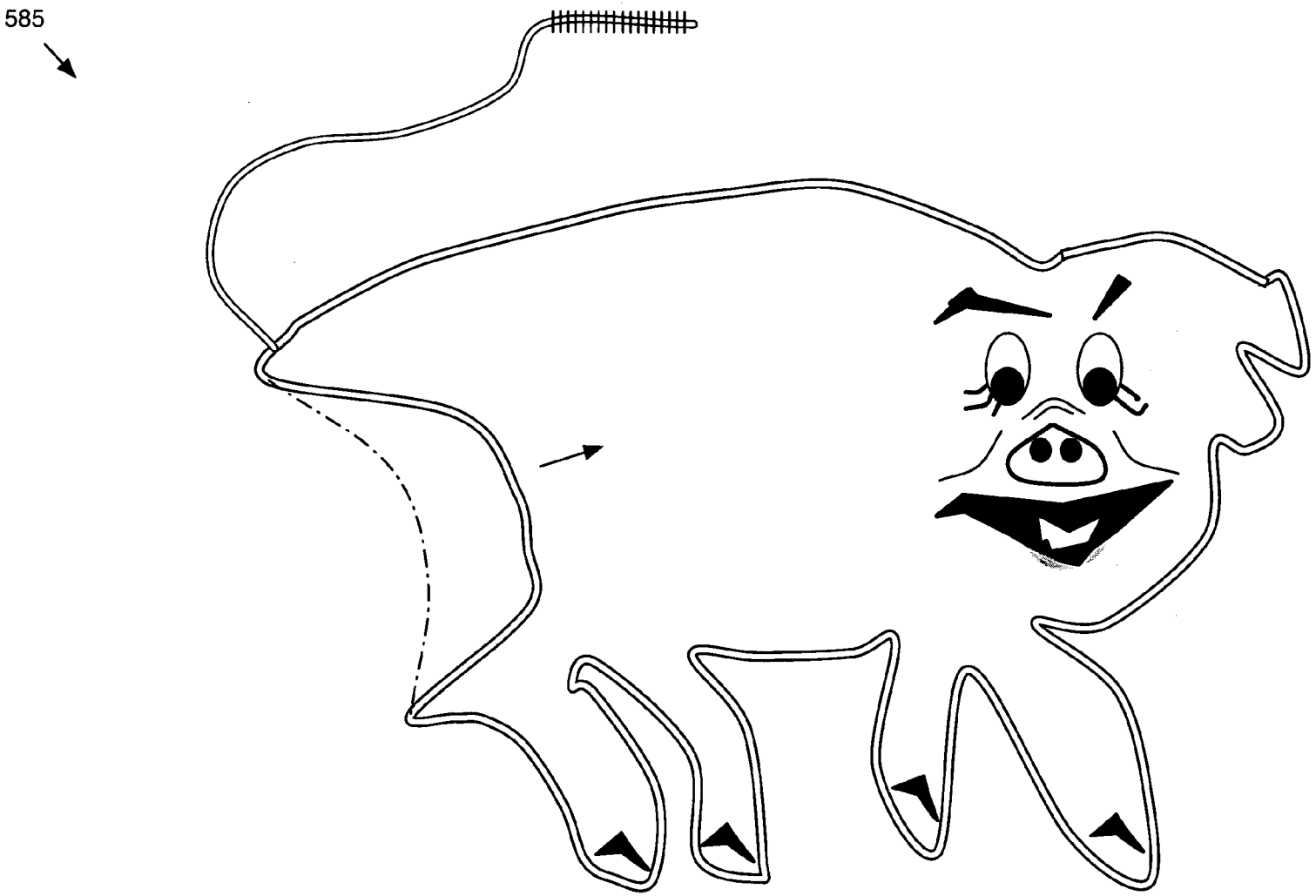

FIG. 17 is a plan view of a preferred embodiment of the present invention.

Figure 18:
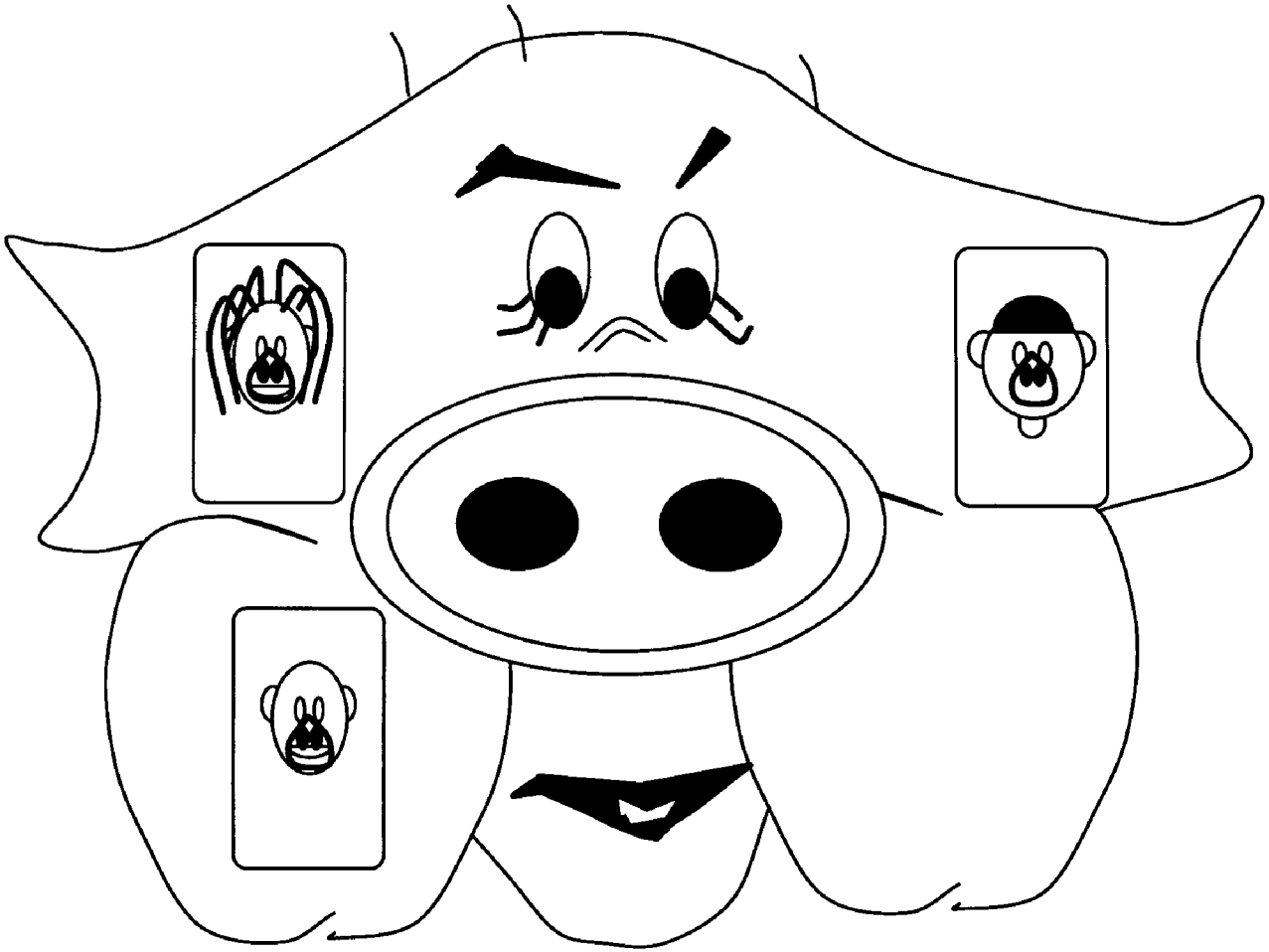

FIG. 18 is a plan view of a preferred embodiment of the present invention.

Figure 19:
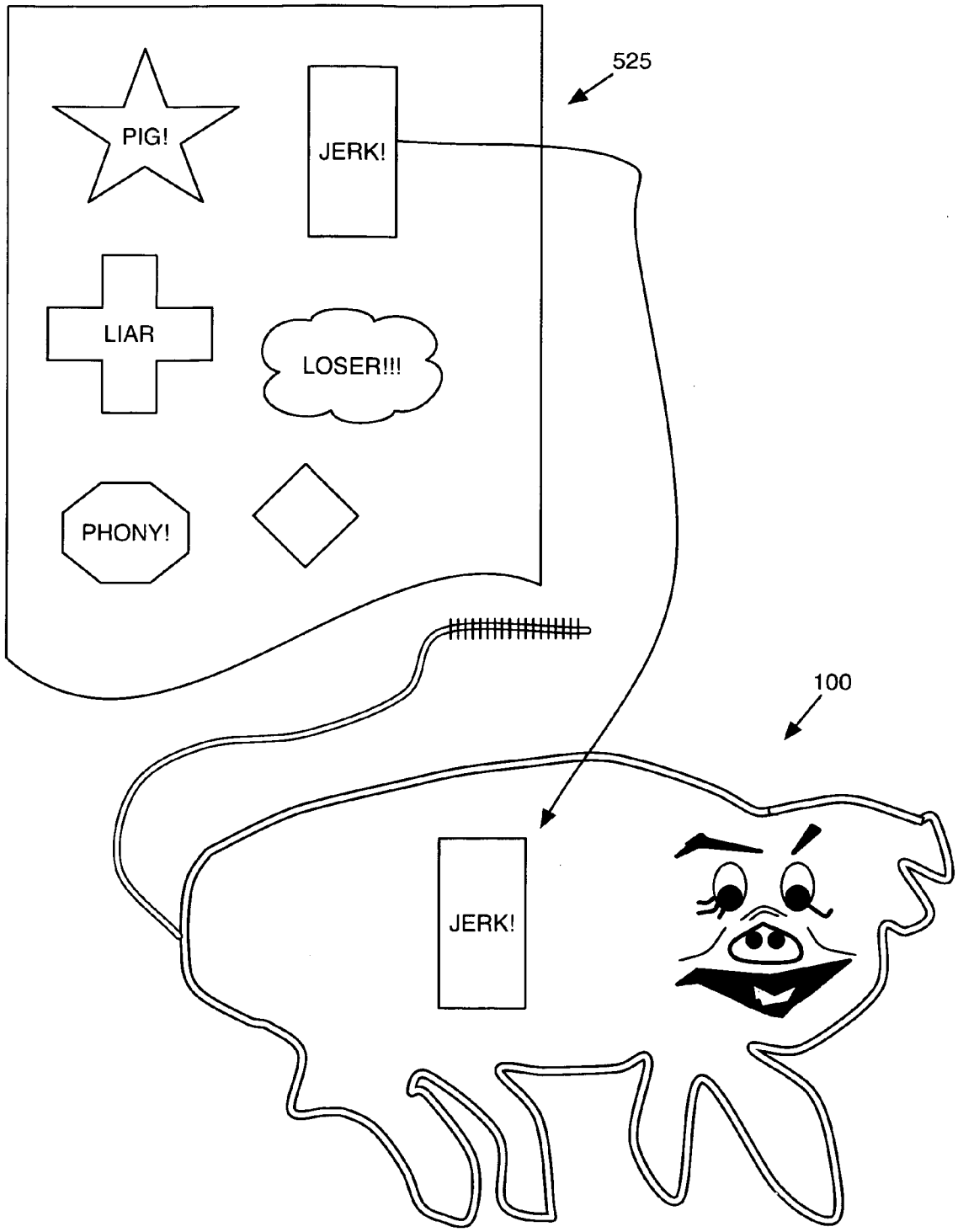

FIG. 19 is a plan view of a preferred embodiment of the present invention.

DESCRIPTION OF PREFERRED EMBODIMENTS

According to a preferred embodiment of the present invention, a unique apparatus is used to display various images or photos upon a board. The present invention is described in enabling detail below.

For the purposes of the present invention the term "pig board" shall mean or refer to any planar member upon which various images or photos are affixed. This board is typically affixed to a wall. The term "board" should not be construed to only comprise wood. The term board is meant to colloquially describe any material such as metal, expanded polystyrene, cork, or similar materials to which pins may be affixed to retain photos.

Figure 2:
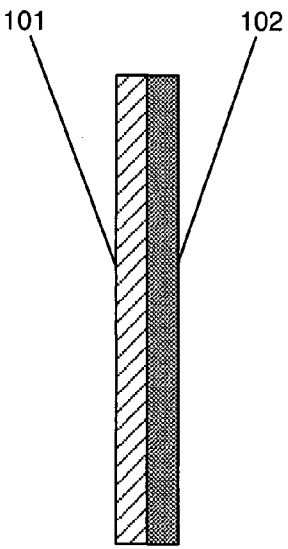
FIG. 2 is a plan view of a preferred embodiment of the present invention.
Figure 1:
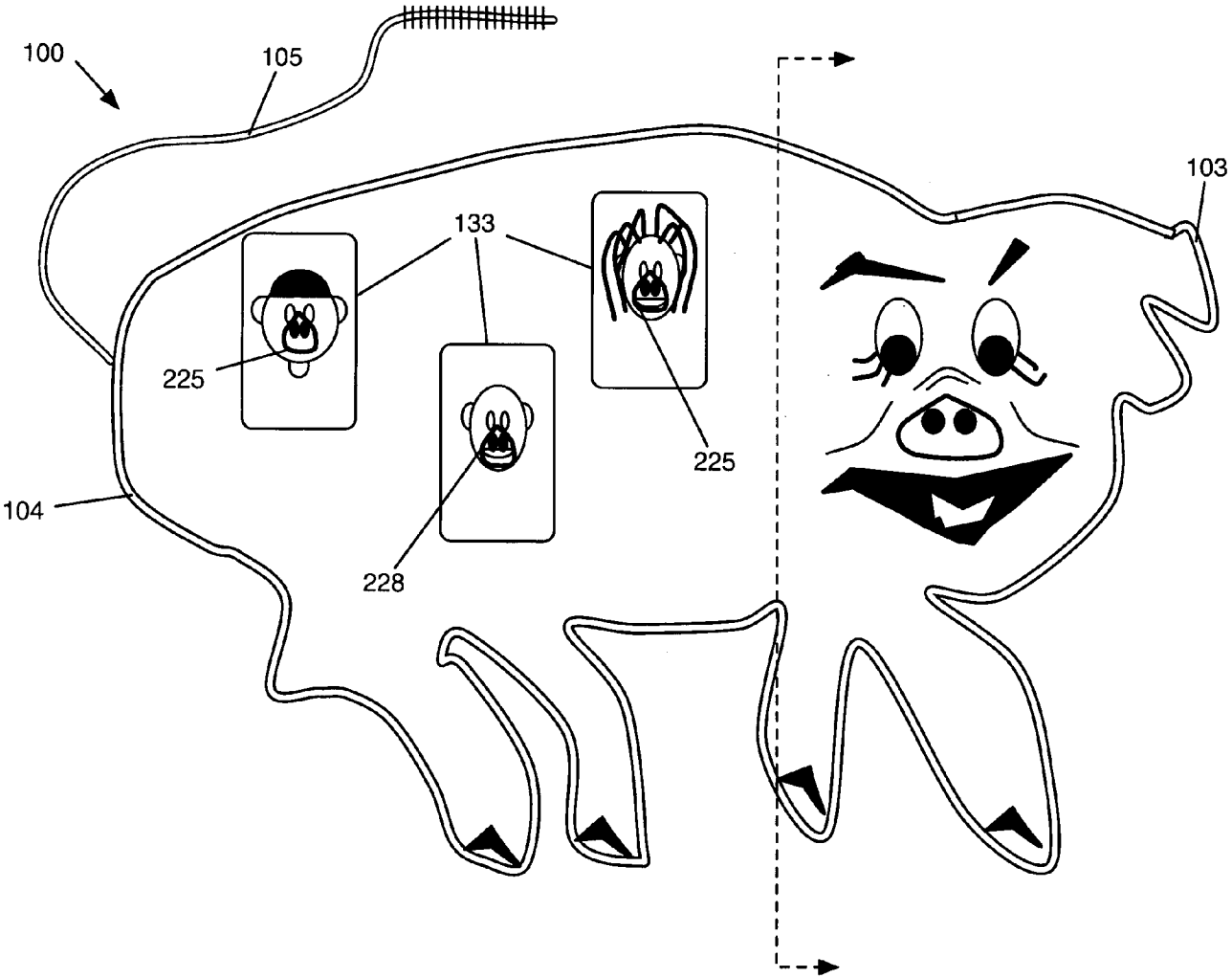
FIG. 1 is a plan view of a preferred embodiment of the present invention.
Figure 3:
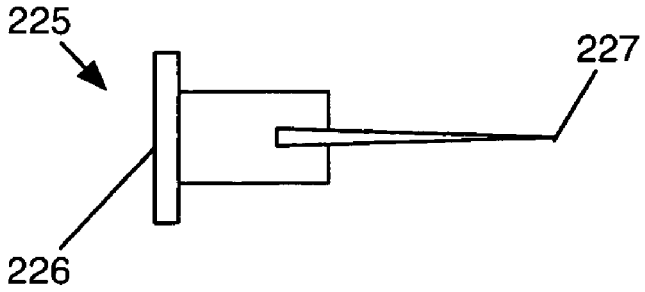
FIG. 3 is a side view of a preferred embodiment of the present invention.

FIG. 1 illustrates a preferred embodiment of the present invention. A pig board 100 for the purpose of displaying various images includes a planar member shaped substantially to the profile of a pig. The planar member comprising a first side 101, a second side 102, an anterior end 103 and a posterior end 104. In some preferred embodiments the pig board may further comprise an elongate member resembling a tail 105 of a pig. The tail is disposed to the posterior end of the planar member.

The first side may be comprised of cork in some preferred embodiments. Other preferred embodiments may use metal for the first side. And in other preferred embodiments the first side may be wood. FIG. 12 and FIG. 13 illustrate that in other preferred embodiments the first side may be a dry-erase board 721 and the second side 722 may be wood or similar material. And in other preferred embodiments the first side may be expanded polystyrene.

Figure 7:
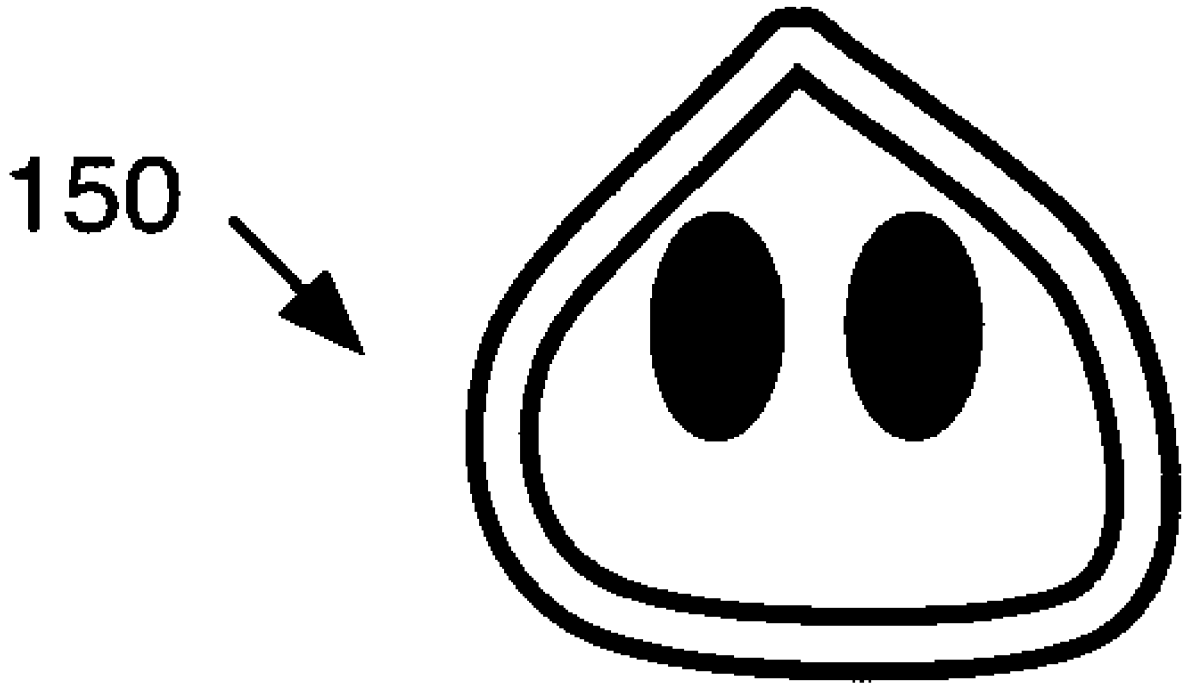
FIG. 7 is a plan view of a preferred embodiment of the present invention.

FIG. 10 and 11 illustrate in other preferred embodiments where a reversible pig board 195 has a top surface 710 comprised of metal and the reverse surface 711 is comprised of cork or similar material such as cardboard which enables pins to be affixed thereto. This embodiment enables the board to be reversible to suit the user's preference., magnets 150 may be used instead as illustrated in FIG. 12 and FIG. 7. FIG. 12 also illustrates that in some preferred embodiments where the dry-erase board is for the first side, an erasable pen 175 may be used.

FIG. 17 illustrates another preferred embodiment where the pig board is a statically charged planar member which may stick to walls without an adhesive backing. Other components of the present invention may be used with this embodiment as well.

FIG. 14 illustrates that in some preferred embodiments the pig board may further comprise demarking indicia 110 for the purpose of illustrating whereto affix various images. Also illustrated in FIG. 14 is a set of adhesive papers 335 for the purpose of writing various notes. In some preferred embodiments the adhesive papers are shaped in the hindside of a pig. In other preferred embodiments the adhesive papers are shaped in the form of a face of a pig.

Figure 8:
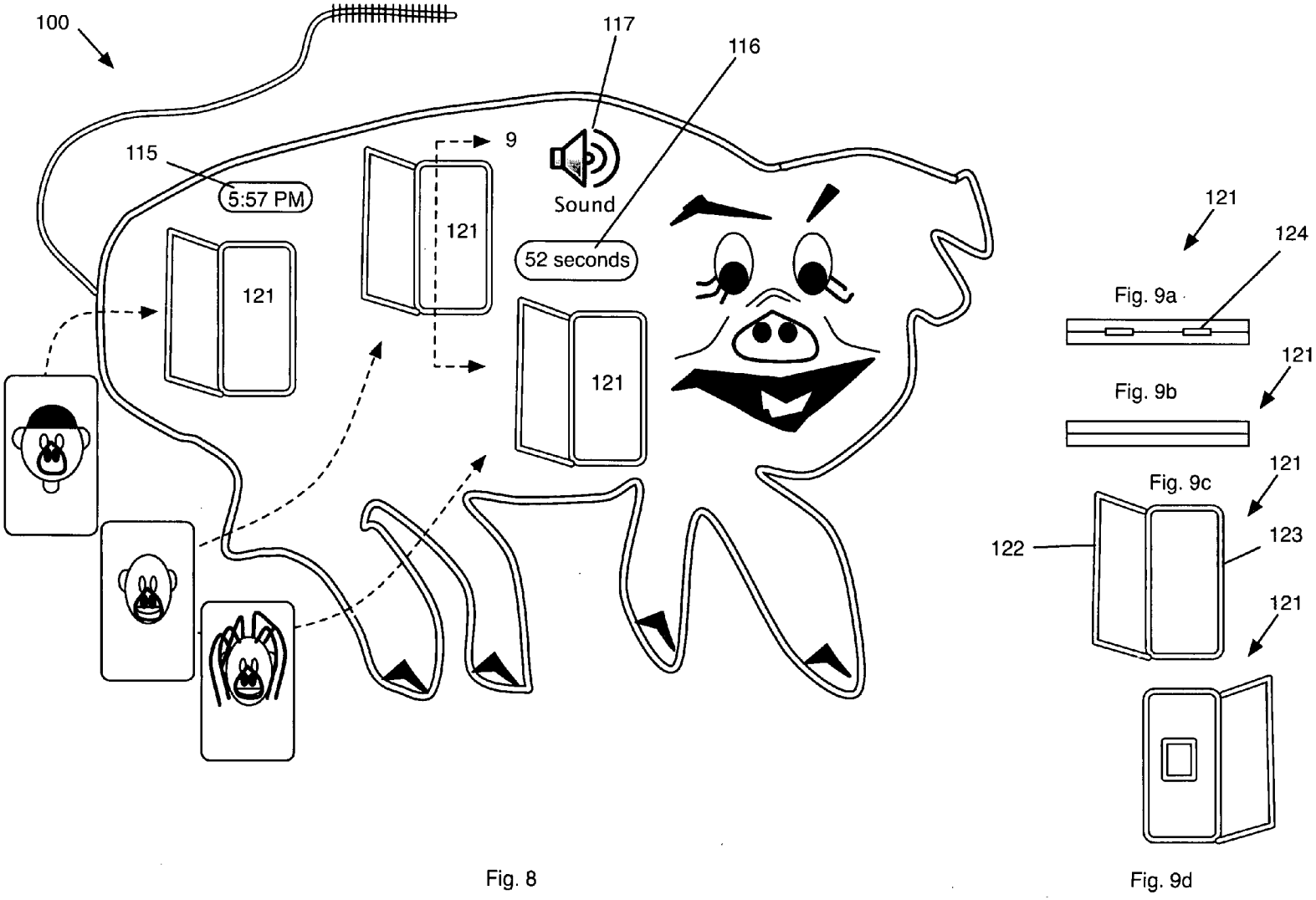
FIG. 8 is a plan view of a preferred embodiment of the present invention.

FIG. 8 illustrates that in some preferred embodiments the pig board may further include a clock 115. In other preferred embodiments the pig board may further include a timing apparatus 116 for counting down the time to a pre-determined event. And in other preferred embodiments the pig board may further comprise an audio apparatus 117 for the purpose of producing various sounds or pre-recorded messages.

FIG. 8 also illustrates that in some preferred embodiments the pig board may further comprise at least one transparent compartment. 121. The transparent compartment is comprised of a first transparent surface 122, a second surface 123, and at least one hinge 124. The first transparent surface is pivotally affixed with the second surface through the hinge.

Figure 4:
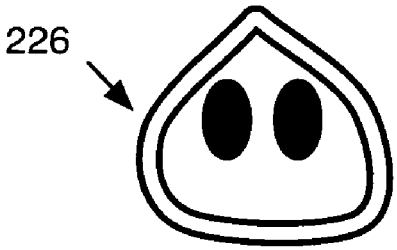
FIG. 4 is a plan view of a preferred embodiment of the present invention.
Figure 5:
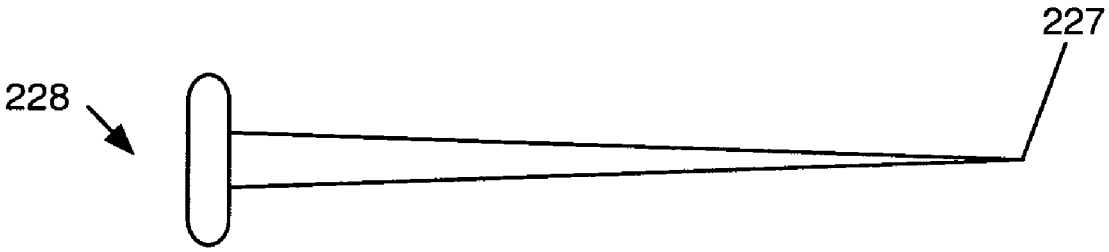
FIG. 5 is a side view of a preferred embodiment of the present invention.
Figure 6:
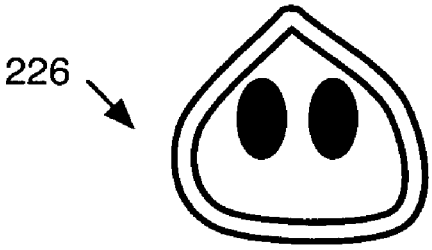
FIG. 6 is a plan view of a preferred embodiment of the present invention.

FIGS. 3-6 illustrate that in some preferred embodiments the pig board may further include one pin 225, 228 for the purpose of affixing an image to the pig board; the pin comprises a first end 227 and a second end 226. FIG. 4 and FIG. 6 illustrate a plan view of an embodiment where the second end 227 further comprises indicia 228 representing the snout of a pig. In some cases, the pin could be molded into the form of a snout.

FIG. 15 illustrates a preferred embodiment further comprising a pig pen 751 and a pig pen holder 750. The pig pen is sized to fit into the pig pen holder. In some preferred embodiments the pig pen is a ball point pen.

FIG. 16 illustrates another preferred embodiment where the pig board 775 takes the form of a posterior end of a pig, as opposed to the overall body of the pig. This posterior pig board profile 775 can be made in the same fashion as those preferred embodiments described above.

FIG. 18 illustrates a preferred embodiment wherein the pig board takes the form of a face of a pig. The pig face embodiment 950 is made in the same fashion as those preferred embodiments described above.

FIG. 19 illustrates another preferred embodiments wherein the pig board may further comprise an assortment of stickers 525 for the purpose of pasting the stickers to the pig board. In some embodiments the stickers will comprise an adhesive side. In other embodiments the stickers may be statically charged or affixed to the pig board by other means. And in other preferred embodiments the stickers may further comprise indicia on the front side. This indicia may comprise various captions or other designs. However, it should be noted that in other preferred embodiments the stickers may not further comprise indicia.

Those skilled in the art will appreciate numerous variations in the present system, configuration and operation that are within the scope of the invention. Those skilled in the art will also appreciate how the principles illustrated in these preferred embodiments can be used in other examples of the invention. A particular reference number in one figure refers to the same element in all of the other figures.

Moreover, It will be apparent to the skilled artisan that there are numerous changes that may be made in embodiments described herein without departing from the spirit and scope of the invention. As such, the invention taught herein by specific examples is limited only by the scope of the claims that follow.

What is claimed is:

1. A pig board for the purpose of displaying various images comprising: a planar member shaped substantially to the profile of a pig, a clock, indicia for the purpose of demarking various places for the purpose of affixing various images, a magnet for the purpose of affixing various images to the pig board, at least one pin for the purpose of affixing an image to the pig board, a timing apparatus for the purpose of illustrating elapsed time, at least one transparent compartment, an audio apparatus for the purpose of producing various sounds or pre-recorded messages, a plurality of adhesive papers, at least one erasable pen for use with a dry-erase board;

the planar member comprising a first side, a second side, an anterior end and a posterior end;

the first side is a dry-erase board;

the transparent compartment is comprised of a first transparent surface, a second surface, and at least one hinge; the first transparent surface is pivotally affixed with the second surface through the hinge;

the pin comprises a first end and a second end; the second end has indicia representing the snout of a pig;

the magnet comprises indicia resembling the snout or the face of a pig.

* * * * *